US007180041B2

(12) United States Patent
Song et al.

(10) Patent No.: US 7,180,041 B2
(45) Date of Patent: Feb. 20, 2007

(54) OVER-THE-RANGE OVEN WITH GUIDE GRILL

(75) Inventors: Sung Bae Song, Anyang-si (KR); Sang Bum Sohn, Seoul (KR); Ho Seon Rew, Seoul (KR)

(73) Assignee: LG Electronics Inc., Seoul (KR)

( * ) Notice: Subject to any disclaimer, the term of this patent is extended or adjusted under 35 U.S.C. 154(b) by 17 days.

(21) Appl. No.: 10/883,730

(22) Filed: Jul. 6, 2004

(65) Prior Publication Data

US 2005/0092746 A1 May 5, 2005

(30) Foreign Application Priority Data

Nov. 5, 2003 (KR) ..... 10-2003-0077999

(51) Int. Cl.
*H05B 6/80* (2006.01)
*F24C 7/02* (2006.01)

(52) U.S. Cl. ..... 219/757; 219/681; 126/21 A; 126/299 R

(58) Field of Classification Search ..... 219/757, 219/681; 126/21 A, 21 R, 299 R, 299 D
See application file for complete search history.

(56) References Cited

U.S. PATENT DOCUMENTS 3,496,704 A * 2/1970 Bandlow ..... 126/299 R
5,886,330 A * 3/1999 Kang et al. ..... 219/757
2002/0084269 A1* 7/2002 Kim ..... 219/757

FOREIGN PATENT DOCUMENTS

KR 2002-34558 5/2002

* cited by examiner

*Primary Examiner*—Philip H. Leung
(74) *Attorney, Agent, or Firm*—Greenblum & Bernstein, P.L.C.

(57) ABSTRACT

The present invention relates to an over-the-range. The over-the-range including: a cavity having an electronic equipment chamber at one side, and within which cooking is performed; a door for opening and closing a cooking chamber within the cavity; a front grill part disposed at the upper side of the cavity and the upper side of the door, for air circulation; and a guide grill part combined to the front grill part such that the guide grill part can be transferred in the front and rear directions in a drawer type to suck and exhaust polluted air at a periphery of the cavity.

23 Claims, 8 Drawing Sheets

OVER-THE-RANGE OVEN WITH GUIDE GRILL

BACKGROUND OF THE INVENTION

1. Field of the Invention

The present invention relates to a microwave range, and more particularly, to an over-the-range including a detachable guide grill part transferred in the front and rear directions of a drawer type to a front grill part, which is installed at a front upper part of a cassette-typed over-the-range. Further, the present invention relates to an over-the-range having a ventilation grill and a ventilation duct integrated with a front surface of a guide grill part, and having a front filter and a ventilation fan, which are installed within the ventilation duct such that convenient replacement and repairs are performed in a drawer type.

2. Description of the Related Art

Generally, an Over-The-Range (Hereinafter, referred to as "OTR") is installed, as an electronic home appliance, on an upper wall surface of a gas or electronic range at a home to cook using microwave and also perform a ventilation function in which indoor air is sucked and exhausted. The OTR refers to a combined hood and microwave range.

A general installation state of the OTR is briefly described with reference to FIG. 1.

As shown in FIG. 1, the over-the-range 110 is installed to be at a predetermined distance over an indoor gas range 120 to cook using microwave and exhaust polluted air. Additionally, the over-the-range 110 is installed with an external size (W×D×H).

FIG. 2 is a schematic view illustrating an air circulation procedure of the over-the-range of FIG. 1, and FIG. 3 is a perspective view illustrating the air circulation procedure of the over-the-range of FIG. 1.

As shown in FIGS. 2 and 3, the over-the-range includes a cavity 111 within which cooking is performed; a door 119 openably installed on a front surface of the cavity 111; and an electronic equipment chamber (not shown) with a plurality of electronic equipment parts installed at one side of the cavity 111.

Additionally, a ventilation fan 115 is installed at an upper rear side of the cavity 111. The ventilation fan 115 sucks the polluted air, which is generated from the gas range installed downward of the over-the-range, into the over-the-range to exhaust the sucked polluted air to the external. Further, The ventilation fan 115 sucks and exhausts air including a high temperature of water vapor. Here, the ventilation fan 115 is comprised of a plurality of centrifugal fans.

For this, as shown in FIGS. 2 and 3, the cavity 111 has suction holes 112 at both upper sides thereof. The cavity 111 has a first suction duct 113 and a second suction duct 114 at lower and lateral sides thereof to flow air, which is sucked through the suction hole 112. Accordingly, the polluted air is sucked through the first suction duct 113 and the second suction duct 114.

Additionally, the ventilation fan 115 is installed at an upper rear side of the cavity 111 to suck the polluted air through the second suction duct 114 and then, recirculate the sucked polluted air through the ventilation duct 116. The ventilation duct 116 is installed at a front side of the ventilation fan 115 and at an upper side of the cavity 111.

The ventilation duct 116 includes a front filter 117 for purifying the polluted air, and a front grill part 118 for exhausting the purified air to the external. Here, the front grill part 118 has a plurality of ventilation grills, which are upward-inclined to upwardly exhaust the purified air.

As described above, the suction and ventilation ducts 113, 114 and 116 function as a passage for exhausting gas, which is generated within the kitchen, to the external and a passage for guiding gas, which is generated from the gas range, to the external of the over-the-range. That is, the polluted air generated at the time of cooking is forcibly circulated through the suction and ventilation ducts 113, 114 and 116, thereby allowing the polluted air to be exhausted through the front grill part 118.

Additionally, the front filter 117 is installed within the ventilation duct 116 to filter a foreign substance included in air, which is ventilated through the over-the-range. The front filter 117 generally uses a charcoal filter. The front filter 117 should be replaced after a predetermined capacity of filtering. Generally, it is desirable that the front filter 117 is replaced every six months.

However, the conventional over-the-range has the following drawbacks.

At the time of the replacement of the front filter 117 disposed at a passage of the ventilation duct 116, the front filter 117 is replaced after the front grill part 118 is separated from a front surface of the outer case.

In case where the filter 117 is not periodically cleaned or replaced to thereby cause a difficulty in air circulation or cause the serious pollution of the filter, the ventilation fan 115 is also overloaded, thereby reducing an efficiency of air circulation or doing a great damage to a whole of the over-the-range. At this time, cleaning should be similarly performed for the grill part 118, which is disposed at a front of the filter 117.

Further, in case where the ventilation fan 115 malfunctions, the over-the-range 110 installed on the wall is again separated for a replacement work or an inspection work.

Accordingly, the conventional over-the-range has an inconvenience in that a whole of the front grill part 118 is separated or the over-the-range is separated from the wall when the ventilation fan 115 or the front filter 117 is replaced or inspected.

SUMMARY OF THE INVENTION

Accordingly, the present invention is directed to an over-the-range that substantially obviates one or more problems due to limitations and disadvantages of the related art.

An object of the present invention is to provide an ventilation device of an over-the-range having a front grill part combined with a front upper part of the over-the-range, and a guide grill part transferred in the front and rear directions to be detachably combined with the front grill part in a drawer type, thereby allowing the front upper part of the over-the-range to be conveniently inspected.

Another object of the present invention is to provide an over-the-range having a guide grill part combined, in a drawer type, to a center of a front grill part, and a front filter and a ventilation fan installed at a ventilation duct within the guide grill part, thereby allowing the front filter and the ventilation fan to be conveniently inspected and replaced.

A further another object of the present invention is to provide an over-the-range having a whole front grill part provided in a drawer type, thereby allowing a front filter and the like to be easily replaced.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided an over-the-range including: a cavity having an electronic equipment chamber at one side, and within which cooking is performed; a door for opening and closing a cooking chamber within the cavity; a front grill part disposed at the upper side of the cavity and the upper side of the door, for air circulation; and a guide grill part combined to the front grill part such that the guide grill part can be transferred in the front and rear directions in a drawer type to suck and exhaust polluted air at a periphery of the cavity.

In another aspect of the present invention, there is provided an over-the-range including: a cavity having an electronic equipment chamber at one side, and within which cooking is performed; a door for opening and closing a cooking chamber within the cavity; and a guide grill part combined to an upper part of the cavity and an upper part of the door such that the guide grill part can be transferred in the front and rear directions in a drawer type to suck and exhaust polluted air at a periphery of the cavity.

In a further aspect of the present invention, there is provided an over-the-range including: a cavity having an electronic equipment chamber at one side, and within which cooking is performed; a door for opening and closing a cooking chamber within the cavity; a front grill part disposed at an upper part of the cavity and an upper part of the door, for air circulation; and a guide grill part combined to the front grill part such that the guide grill part can be transferred in the front and rear directions in a drawer type to suck and upwardly exhaust polluted air at a periphery of the cavity.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
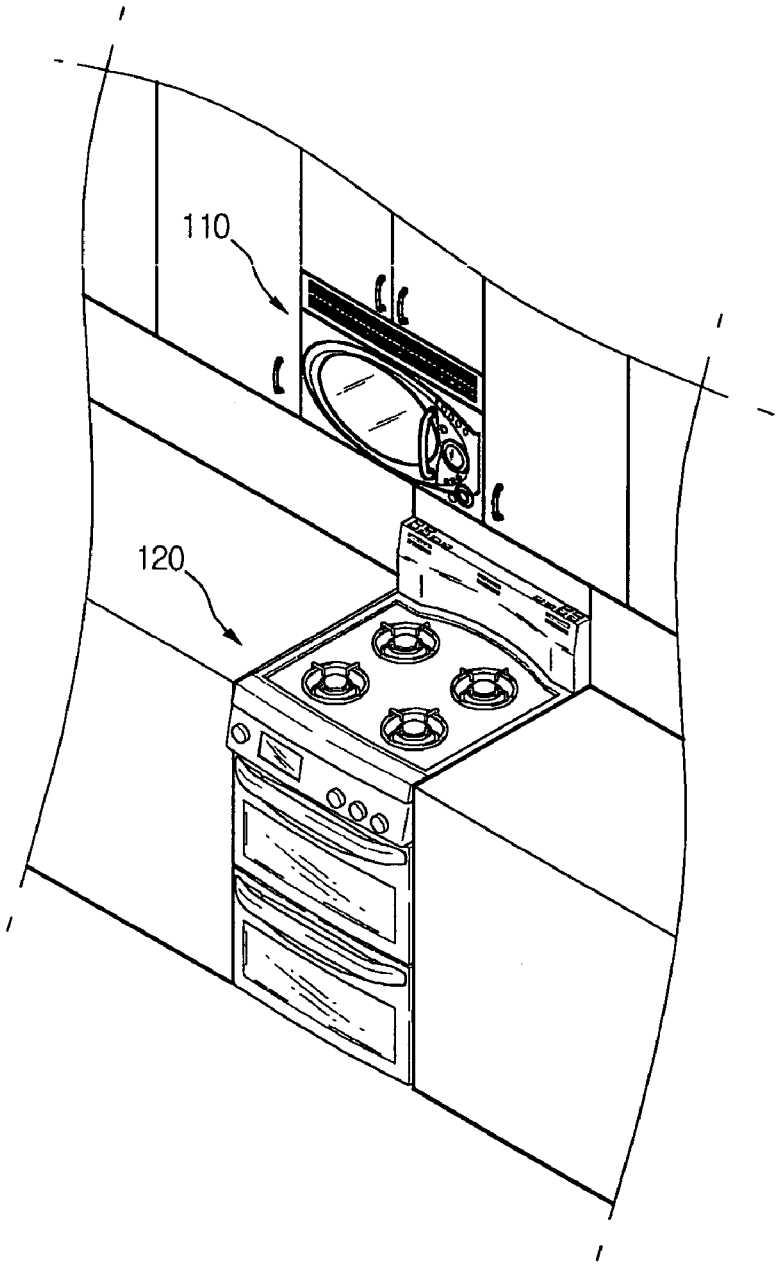
Fig.1 Related Art
FIG. 1 is a perspective view illustrating a state in which a general over-the-range is installed.
Figure 2:
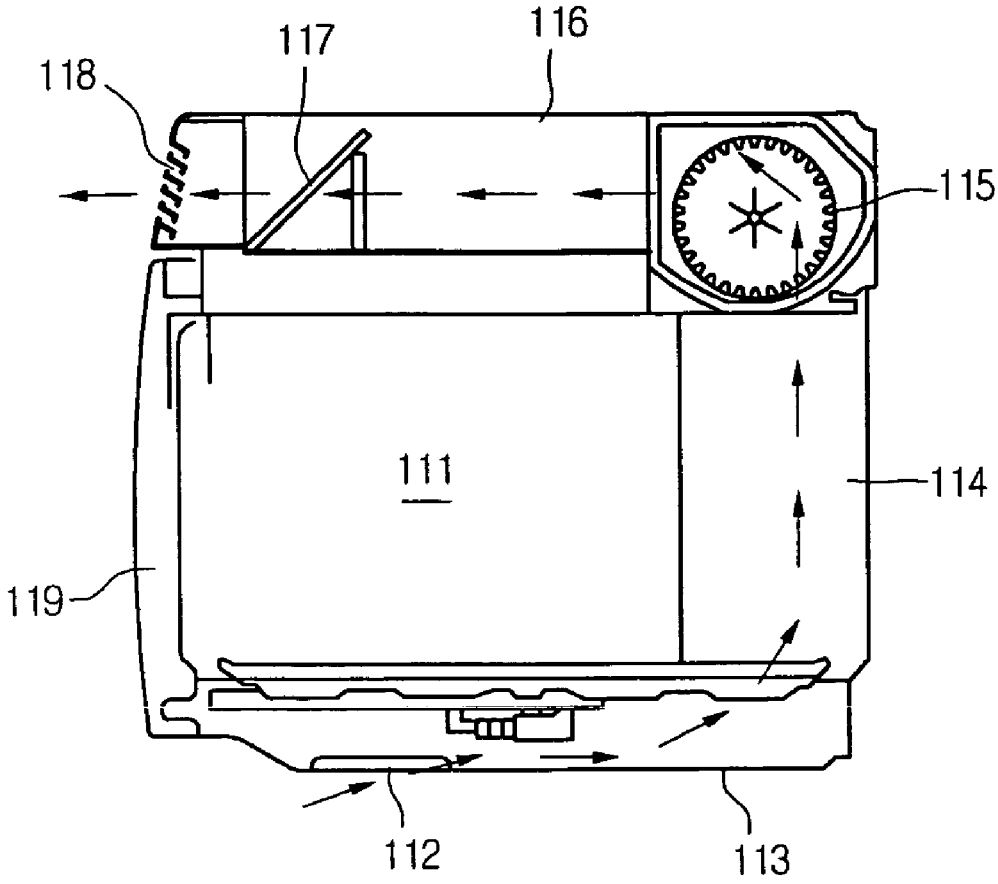
Fig.2 Related Art
FIG. 2 is a schematic view illustrating an air circulation procedure of an over-the-range of FIG. 1.
Figure 3:
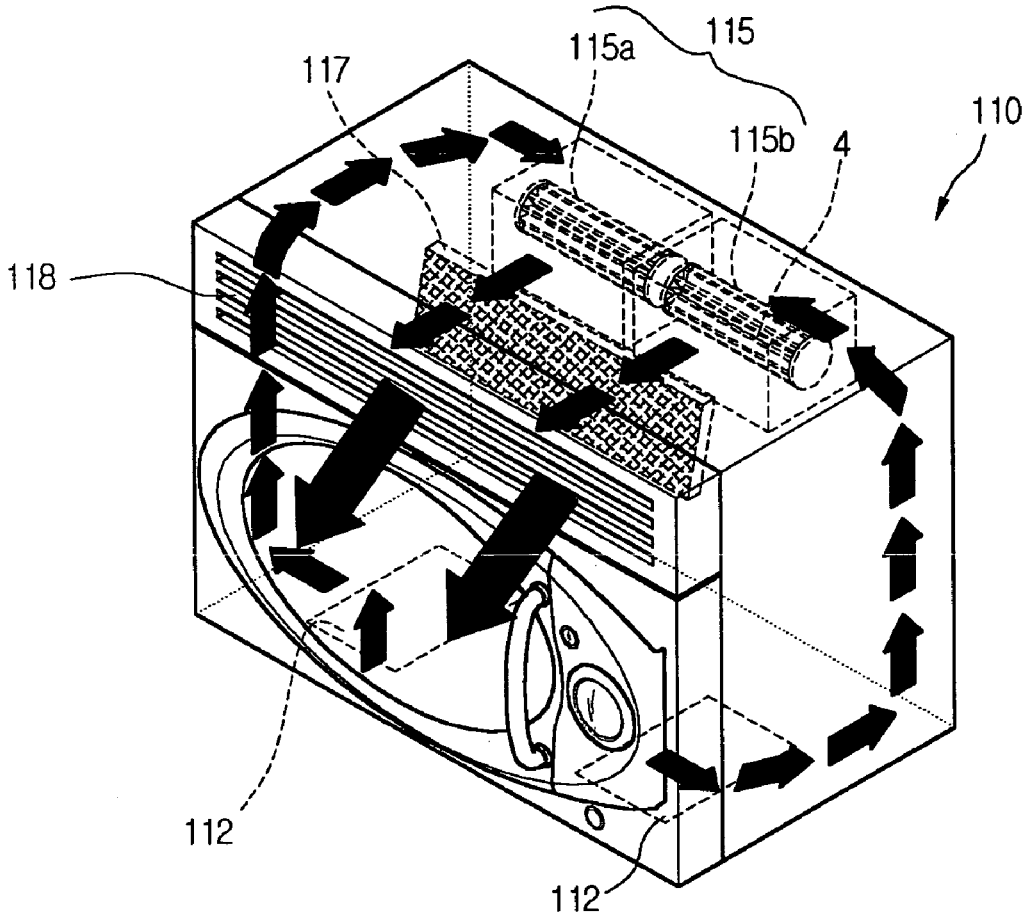
Fig.3 Related Art
FIG. 3 is a perspective view illustrating an air circulation procedure of an over-the-range of FIG. 1.
Figure 4:
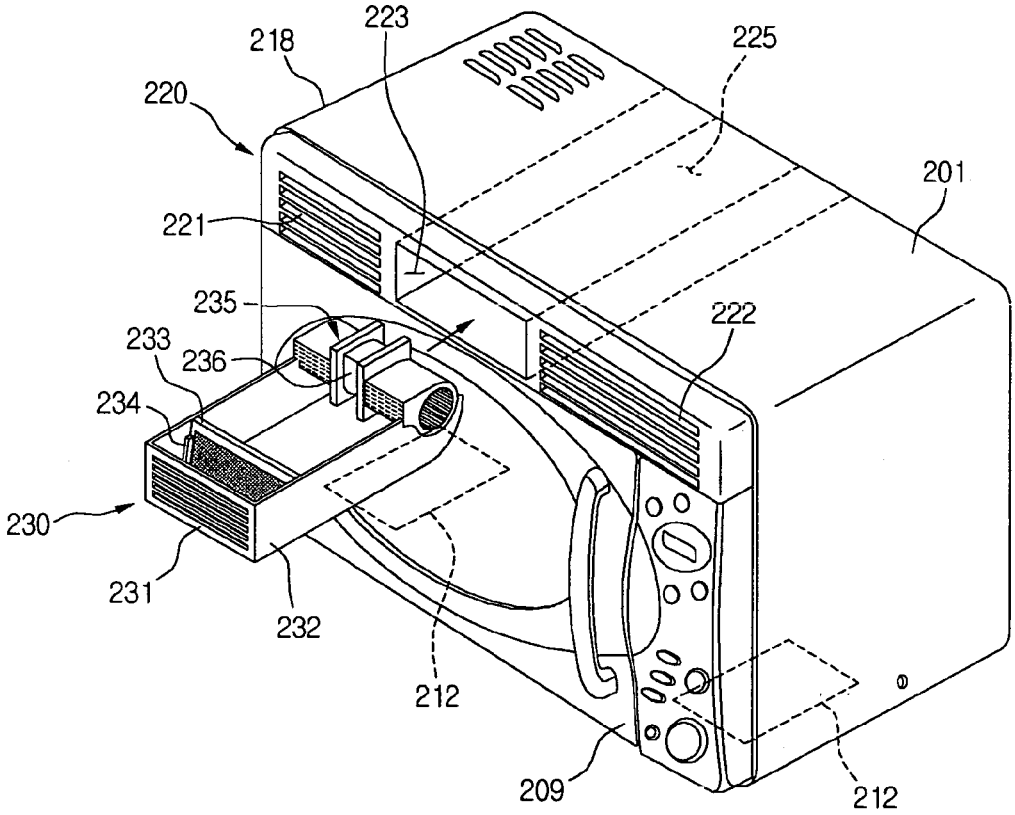
FIG. 4 is a disassembled perspective view illustrating a drawer-type guide grill part of an over-the-range according to an embodiment of the present invention.

FIG. 4 is a disassembled perspective view illustrating a drawer-type guide grill part of an over-the-range according to an embodiment of the present invention.

Figure 5:
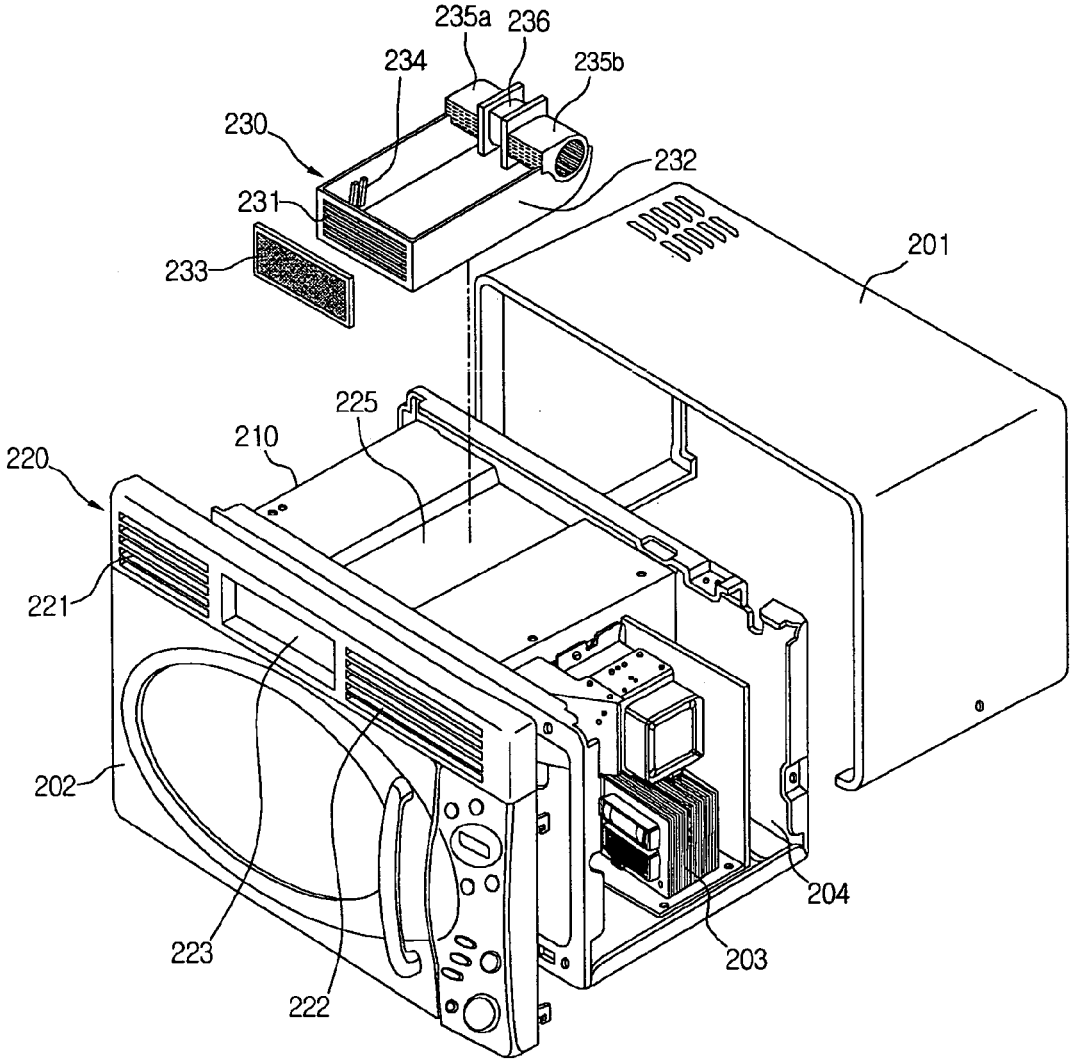
FIG. 5 is a disassembled perspective view illustrating an over-the-range according to an embodiment of the present invention.

FIG. 5 is a disassembled perspective view illustrating the over-the-range according to the embodiment of the present invention.

As shown in FIGS. 4 and 5, the over-the-range includes a cavity 210 within which cooking is performed; an outer case 201 disposed at the exterior of the cavity 210; a door 202 disposed at a front surface of the cavity 210; an electronic equipment chamber(not shown) provided at one side of the cavity 210 to house an electronic equipment 203; a front grill part 220 installed at an upper part of the door 202 to circulate polluted air; and a guide grill part 230 installed in a drawer type at a center of the front grill part 220.

Here, the guide grill part 230 includes a front ventilation grill 231, a ventilation duct 232, a front filter 233 disposed on a ventilation passage; and a rear ventilation fan 235.

As shown in FIGS. 4 and 5, the above-constructed over-the-range includes the electronic equipment chamber disposed at the one side of the cavity 210, the door 202 openably combined to a front surface of the cavity 210, and the outer case 201 combined to the exterior of the cavity 210.

The front grill part 220 is combined to a front upper part of the cavity 210 and an upper part of the door 202. A plurality of grills 221 and 222 are inclined in the width direction at the left and right sides of the front grill part 220. The front grill part 220 has a guide hole 223 at a center thereof.

The guide grill part 230 having a predetermined shape is slid in the front and rear directions in the drawer type through the guide hole 223, which is provided at the center of the front grill part 220, to be detachably combined to an upper surface 225 of the cavity 210.

The guide grill part 230 is comprised of the ventilation grill 231, the ventilation duct 232, the front filter 233 provided on the ventilation duct 232, and the ventilation fan 235. The ventilation grill 231 is disposed on the same plane as the front grill part 220. The ventilation duct 232 is integrated with the ventilation grill 231, and functions as a ventilation passage of the ventilation fan 235.

Additionally, the front filter 233 is installed at the ventilation duct 232 to filter and purify the polluted air, which is exhausted through the ventilation fan 235. The front filter 233 uses a charcoal filter to filter a foreign substance included in heat, smoke or the like, which is generated from kitchen and a gas range installed downward of the over-the-range when cooking is performed. The front filter 233 is replaced at a predetermined period.

A support member 234 is installed in the ventilation duct 232 to detachably support the front filter 233. The support member 234 is inclined toward the ventilation fan 235. The support member 234 has a guide rail to allow both ends of the front filter 233 to be fitted thereinto, thereby combining the front filter 233 with the support member 234.

Additionally, the ventilation fan 235 is comprised of a plurality of centrifugal fans 235*a* and 235*b*. The ventilation fans 235*a* and 235*b* are disposed at the left/right sides of a ventilation motor 236, and are screwed to the rear part of the ventilation duct 232. The ventilation fan 235 sucks the polluted air at the rear left/right sides of the guide grill part 230 and exhausts the sucked air to the front side of the guide grill part 230. The ventilation motor 236 is installed between the ventilation fans 235*a* and 235*b* to drive the ventilation fan 235.

In case where the guide grill part 230 is installed in the drawer type at the upper side of the door 202, which is combined to a front surface of the over-the-range at a center of the front grill part 220, a user can easily access to the front filter 233, which is installed in the guide grill part 230, and the ventilation fan 235. That is, the drawer-type guide grill part 230 is combined to the center of the front grill part 220, thereby allowing the guide grill part 230 to be transferred in the front and rear directions in the drawer type.

Figure 6:
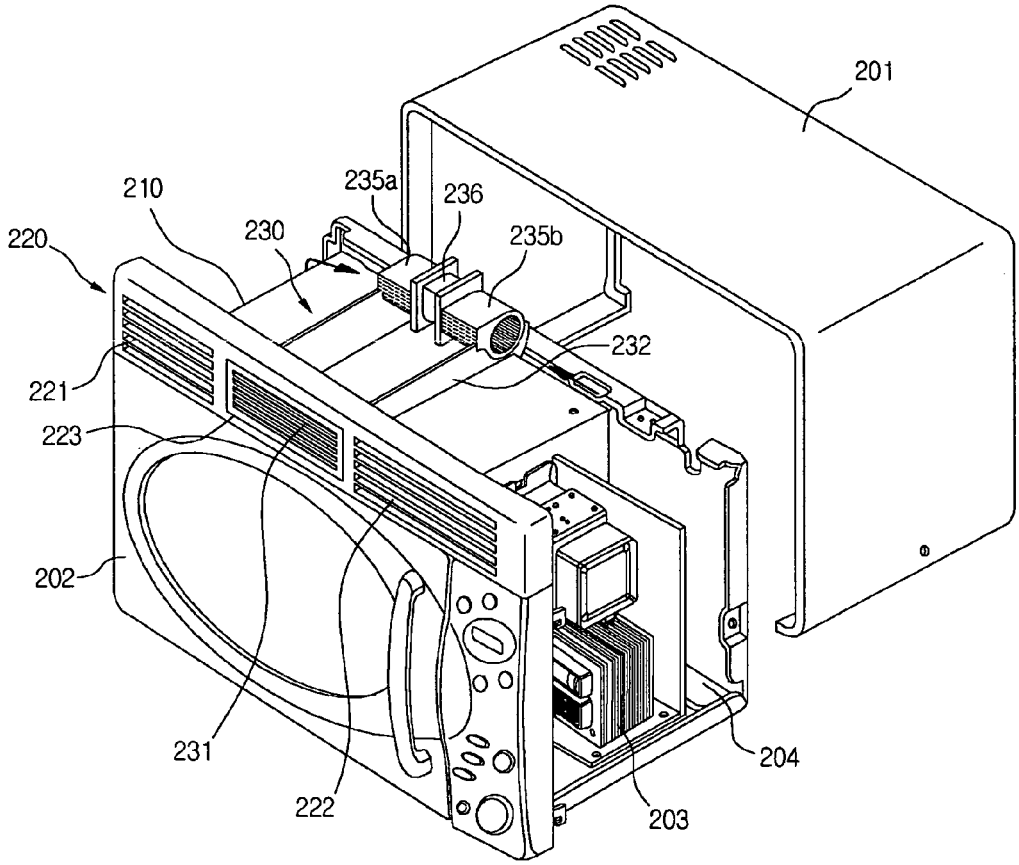
FIG. 6 is a perspective view illustrating a combination state of an over-the-range according to an embodiment of the present invention.

FIG. 6 is a perspective view illustrating a combination state of the over-the-range according to the embodiment of the present invention.

Referring to FIG. 6, an operation of the over-the-range is described as follows.

If the ventilation motor 236 operates the plurality of ventilation fans 235*a* and 235*b*, the ventilation fans 235*a* and 235*b* suck the polluted air through a suction duct 204, which is provided at the left/right sides of the cavity 210. That is, the ventilation fans 235*a* and 235*b* suck air for airflow to perform a hood function, and suck the polluted air generated from the gas range and air for cooling the electronic equipment.

The polluted air is exhausted by the ventilation fans 235*a* and 235*b* to flow along an internal passage of the ventilation duct 232 and pass through the front filter 233. At this time, the front filter 233 filters and purifies the polluted air to exhaust the purified air to the external through the ventilation grill 231.

After that, when the user pulls the guide grill part 230 to inspect the front filter 233 or the ventilation fan 235, the guide grill part 230 is slid and released, in the front direction as shown in FIG. 4, from a front surface of the front grill part 220 in the drawer type. By doing so, the front filter 233 and the ventilation fan 235 of the quide grill part 230 are exposed to the user. Accordingly, the user can replace the front filter 233, or can disconnect a connector of the ventilation fan 235 to replace or inspect the ventilation fan 235 in an exposure state.

After that, if the user again pushes the guide grill part 230 in the rear direction, the guide grill part 230 moves in the rear direction through the guide hole 223 of the front grill part 220 and the upper part 225 of the cavity 221. At this time, the ventilation grill 231 of the guide grill part 230 is disposed on the same plane as the front grill part 220 such that they function as one front grill.

Further, it is desirable that the ventilation grill 231 has a groove or a protrusion functioning as a knob at one side thereof such that the user can easily use the guide grill part 230 in the drawer type.

Structural elements are installed on an upper part of the cavity within the drawer-type guide grill part 230 of the cassette-type over-the-range. Accordingly, the user can move the guide grill part 230 in the drawer-type to easily replace or inspect the structural elements.

Figure 7:
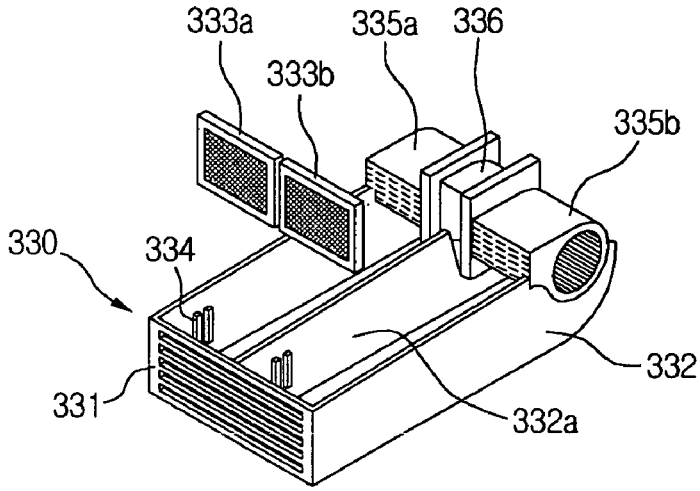
FIG. 7 is a view illustrating a construction of a drawer-type guide grill part according another embodiment of the present invention.

FIG. 7 is a view illustrating a construction of a drawer-type guide grill part according another embodiment of the present invention.

Referring to FIG. 7, a ventilation duct 332 has a central wall 332*a* at a rear of a ventilation grill 331 and between a plurality of ventilation fans 335*a* and 335*b*, thereby respectively forming ventilation passages at a right-side ventilation fan 335*a* and a left-side ventilation fan 335*b*.

Additionally, front filters 333*a* and 333*b* are respectively provided at the passages of the ventilation duct 332. Accordingly, there is an effect in that both of the front filters 333*a* and 333*b* are replaced independently, or are not required for concurrent replacement.

A support member 334 is installed on an inner lateral surface of the ventilation duct 332 and on an inner surface of the central wall 332*a* to support the front filters 333*a* and 333*b* and allow easy attachment/detachment to/from the support member 334, thereby allowing convenient replacement of the front filters 333*a* and 333*b*.

Figure 8:
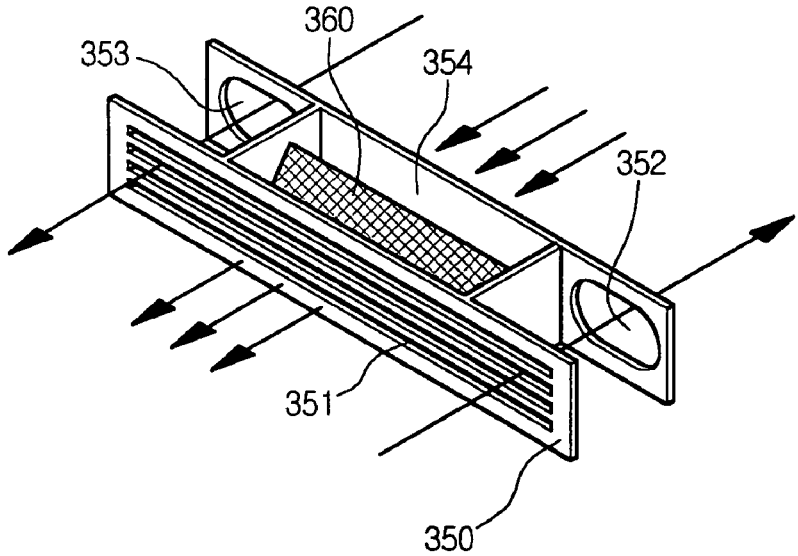
FIG. 8 is a view illustrating a construction of a drawer-type guide grill part according to a further another embodiment of the present invention.

FIG. 8 is a view illustrating a construction of a drawer-type guide grill part according to a further another embodiment of the present invention.

Referring to FIG. 8, a guide grill part 350 is installed at a whole upper part of a door to be constructed in a drawer type. The guide grill part 350 has a ventilation grill 351 at a front surface thereof. A front filter 360 is provided at a ventilation passage of the ventilation grill 351. A suction hole 352 and an exhaust hole 353 are provided at rear left/right sides from of the guide grill part 351.

As shown in FIG. 8, the guide grill part 350 has the same width as the over-the-range. The guide grill part 350 is installed at a whole upper part of the over-the-range. The guide grill part 350 has a "ㅐ"-shaped frame structure to provide a front ventilation grill 351 at a front side and provide the suction hole 352 and the exhaust hole 353 at rear right/left sides. Accordingly, sucked air cools an electronic equipment disposed at the one side of a cavity, and heated air is exhausted through the exhaust hole 353 provided at the left side of the cavity. Additionally, the front filter 360 is installed at a center of the front ventilation grill 351 to filter exhausted air, which is exhausted through the exhaust hole 354 by using a ventilation fan disposed at a rear of a cavity, and exhaust the filtered air to the external through the front ventilation grill 351.

Figure 9:
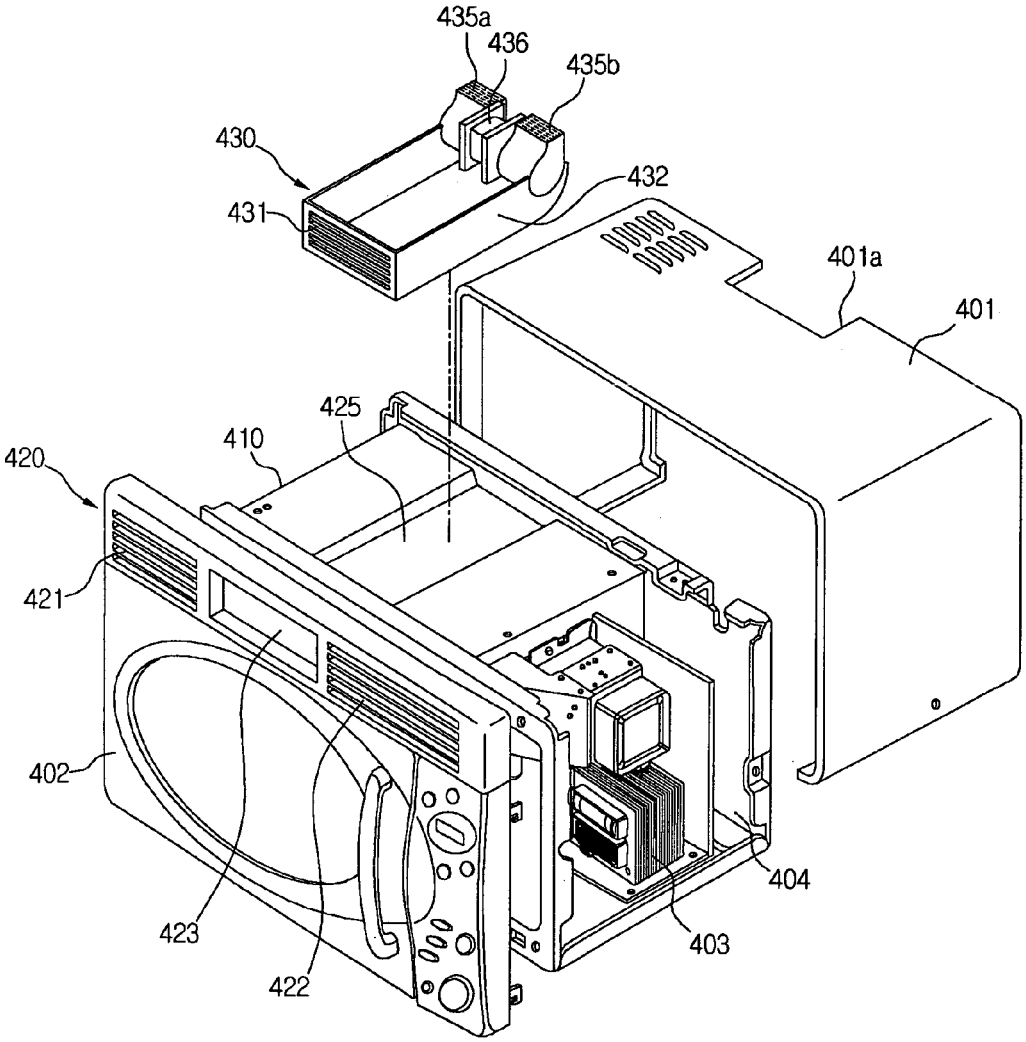
FIG. 9 is a disassembled perspective view illustrating a construction of an over-the-range according to a still another embodiment of the present invention.

FIG. 9 is a disassembled perspective view illustrating a construction of an over-the-range according to a still another embodiment of the present invention.

As shown in FIG. 9, a door 402 is combined to a front surface of a cavity 410. A front grill part 420 is mounted on an upper part of the door 402. Front grills 421 and 422 are installed at the left and right sides of the front grill part 420, and a guide hole 423 is provided at a center of the front grill part 420.

Additionally, a guide grill part 430 is installed on an upper part 425 of the cavity 410 and lengthwise of the upper part of the door 402. The guide grill part 430 is transferred in the front and rear directions through the guide hole 423, which is provided at the center of the front grill part 420.

The guide grill part 430 includes a ventilation grill 431 at a front of a duct 432, and ventilation fans 435*a* and 435*b* at a rear of the duct 432 for upward exhaustion. Here, an outer case 401 has an exhaust hole 401*a* at a rear thereof in order to provide ventilation passages of the ventilation fans 435*a* and 435*b*.

The ventilation passage can be provided upwardly of the over-the-range as shown in FIG. 9. In FIG. 9, the guide grill part 430 can be drawn out in the drawer type, thereby allowing easy replacement and inspection of the ventilation fans 435*a* and 435*b*.

Further, the ventilation fans 435*a* and 435*b* are driven by a central ventilation motor 436 to suck polluted air from the both sides of the cavity and upwardly exhaust the sucked polluted air. At this time, the exhausted air is exhausted to the external by using the ventilation duct connected to the over-the-range.

In the inventive over-the-range, a portion of the front grill part 420 is constructed in the drawer type to allow the user to conveniently replace and inspect structural parts disposed on the upper part of the cavity.

Further, due to the drawer-type guide grill part, it is not required that the over-the-range is separated from the wall and the like to replace or inspect the front filter or the ventilation fan.

Accordingly, the inventive over-the-range has an effect in that the filter can be easily replaced since due to the drawer-type guide grill part, the user can draw-out the front filter, the ventilation fan and the like toward the external by a predetermined distance and then performs replacement, inspection and cleaning works and the like, and after completion of the works, the user can again push them to be in an original position.

Further, the inventive over-the-range has an effect in that the user can draw-out the guide grill part to replace or inspect malfunctioning ventilation fan, thereby providing repair convenience.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An over-the-range oven comprising:

a cavity having an electronic equipment chamber at one side, and within which cooking is performed;

a door for opening and closing a cooking chamber within the cavity;

a front grill part disposed at the upper side of the cavity and the upper side of the door, for air circulation; and a guide grill part combined to the front grill part such that the guide grill part can be transferred in the front and rear directions as a drawer to suck and exhaust polluted air at a periphery of the cavity, wherein the guide grill part includes a ventilation grill disposed at a front surface thereof, the ventilation grill being disposed in the same plane as the front grill part.

2. The over-the-range oven according to claim 1, wherein the front grill part has front grills at the left and right sides, and a guide hole at a center for receiving the guide grill part therein.

3. The over-the-range oven according to claim 1, wherein the guide grill part comprises:

a ventilation duct integrated with a rear part of the ventilation grill, for exhausting air to the external; and a front filter mounted on the ventilation duct, for filtering air exhausted through the ventilation duct.

4. The over-the-range oven according to claim 3, wherein the guide grill pad further comprises a ventilation fan mounted at a rear of the ventilation duct, for sucking the polluted air at the periphery of the cavity and exhausting the sucked polluted air through the ventilation duct.

5. The over-the-range oven according to claim 4, wherein the ventilation fan is comprised of a plurality of centrifugal fans, and the centrifugal fans are installed at the rear left/right sides of the cavity to suck air at the lateral sides and exhaust the sucked air to the ventilation duct.

6. The over-the-range oven according to claim 1, wherein the guide grill part comprises:

a ventilation duct being integrated with the ventilation grill, and forming a ventilation passage;

a front filter for filtering air exhausted to the ventilation passage of the ventilation duct; and a plurality of ventilation fans disposed at a rear of the ventilation duct, for sucking the polluted air at the left/right sides of a cavity and exhausting the sucked polluted air to the ventilation duct.

7. The over-the-range oven according to claim 6, wherein the ventilation grill has a knob for facilitating a forward transfer of the guide grill part to provide smooth inspection and replacement of the front filter and/or the ventilation fan.

8. The over-the-range oven according to claim 1, wherein the guide grill part is installed at an upper part of the door and between the cavity and an outer case disposed at a periphery of the cavity to be moved in the front and rear directions as a drawer, thereby facilitating replacement and inspection of elements which are mounted on an upper part of the cavity.

9. An over-the-range oven comprising:

a cavity having an electronic equipment chamber at one side, and within which cooking is performed;

a door for opening and closing a cooking chamber within the cavity;

a guide grill part combined to an upper part of the cavity and an upper part of the door such that the guide grill part can be transferred in the front and rear directions as a drawer to suck and exhaust polluted air at a periphery of the cavity; and a front grill part having front grills at the left and right sides, and a guide hole at a center for receiving the guide grill part therein, wherein the guide grill part includes a ventilation grill disposed at a front surface thereof, the ventilation grill being disposed in the same plane as the front grill part.

10. The over-the-range oven according to claim 9, wherein the guide grill part is installed at an upper part of the door and between the cavity and an outer case disposed at a periphery of the cavity to be moved in the front and rear directions as a drawer, thereby facilitating replacement and inspection of elements which are mounted on an upper part of the cavity.

11. The over-the-range oven according to claim 9, wherein the guide grill part comprises:

a ventilation duct integrated with a rear part of the ventilation grill, for exhausting air to the external; and a front filter mounted on the ventilation duct, for filtering air exhausted through the ventilation duct.

12. The over-the-range oven according to claim 11, wherein the guide grill part further comprises a ventilation fan mounted at a rear of the ventilation duct, for sucking the polluted air at the periphery of the cavity and exhausting the sucked polluted air through the ventilation duct.

13. The over-the-range oven according to claim 12, wherein the ventilation fan is comprised of a plurality of centrifugal fans, and the centrifugal fans are installed at the rear left/right sides of the cavity to suck air at the lateral sides and exhaust the sucked air to the ventilation duct.

14. The over-the-range oven according to claim 9, wherein the guide grill part comprises:

a ventilation duct being integrated with the ventilation grill, and forming a ventilation passage;

a front filter for filtering air exhausted to the ventilation passage of the ventilation duct; and a plurality of ventilation fans disposed at a rear of the ventilation duct, for sucking the polluted air at the left/right sides of a cavity and exhausting the sucked polluted air to the ventilation duct.

15. The over-the-range oven according to claim 14, wherein the ventilation grill has a knob for facilitating a forward transfer of the guide grill part to provide smooth inspection and replacement of the front filter and/or the ventilation fan.

16. An over-the-range oven comprising:

a cavity having an electronic equipment chamber at one side, and within which cooking is performed;

a door for opening and closing a cooking chamber within the cavity;

a front grill part disposed at an upper part of the cavity and an upper part of the door, for air circulation; and a guide grill part combined to the front grill part such that the guide grill part can be transferred in the front and rear directions as a drawer to suck and upwardly exhaust polluted air at a periphery of the cavity, wherein the guide grill part includes a ventilation grill disposed at a front surface thereof, the ventilation grill being disposed in the same plane as the front grill part.

17. The over-the-range oven according to claim 16, wherein the guide grill part is installed at an upper part of the door and between the cavity and an outer case disposed at a periphery of the cavity to be moved in the front and rear directions as a drawer, thereby facilitating replacement and inspection of elements which are mounted on an upper part of the cavity.

18. The over-the-range oven according to claim 16, wherein the front grill part has front grills at the left and right sides, and a guide hole at a center for receiving the guide grill part therein.

19. The over-the-range oven according to claim 16, wherein the guide grill part comprises:

a ventilation duct integrated with a rear part of the ventilation grill, for exhausting air to the external; and a front filter mounted on the ventilation duct, for filtering air exhausted through the ventilation duct.

20. The over-the-range oven according to claim 19, wherein the guide grill part further comprises a ventilation fan mounted at a rear of the ventilation duct, for sucking the polluted air at the periphery of the cavity and exhausting the sucked polluted air through the ventilation duct.

21. The over-the-range oven according to claim 20, wherein the ventilation fan is comprised of a plurality of centrifugal fans, and the centrifugal fans are installed at the rear left/right sides of the cavity to suck air at the lateral sides and exhaust the sucked air to the ventilation duct.

22. The over-the-range oven according to claim 16, wherein the guide grill part comprises:

a ventilation duct being integrated with the ventilation grill, and forming a ventilation passage;

a front filter for filtering air exhausted to the ventilation passage of the ventilation duct; and a plurality of ventilation fans disposed at a rear of the ventilation duct, for sucking the polluted air at the left/right sides of a cavity and exhausting the sucked polluted air to the ventilation duct.

23. The over-the-range oven according to claim 22, wherein the ventilation grill has a knob for facilitating a forward transfer of the guide grill part to provide smooth inspection and replacement of the front filter and/or the ventilation fan.

* * * * *